US005967454A

United States Patent [19]

Yarnell et al.

[11] Patent Number: 5,967,454

[45] Date of Patent: Oct. 19, 1999

[54] TWIN SHEET REEL CORE

[75] Inventors: L. Bryan Yarnell; Daniel E. Major, both of Knoxville, Tenn.

[73] Assignee: Formall, Inc., Knoxville, Tex.

[21] Appl. No.: 09/201,031

[22] Filed: Nov. 30, 1998

[51] Int. Cl.[6] ..... B65H 75/14

[52] U.S. Cl. ..... 242/608.4; 242/118.32; 242/607; 242/609.1; 242/610.2; 242/610.3; 242/610.6; 242/613

[58] Field of Search ..... 242/607, 608, 242/608.2, 608.4, 608.6, 609, 609.1, 610, 610.1, 610.2, 610.3, 610.6, 613, 614, 118.32, 118.6, 118.7, 118.8

[56] References Cited

U.S. PATENT DOCUMENTS

| | | | |
|---|---|---|---|
| 2,452,378 | 10/1948 | Hudson | 242/608.4 |
| 3,235,203 | 2/1966 | Antliff | 242/608.4 |
| 3,433,355 | 3/1969 | Smith | 242/613 |
| 3,544,032 | 12/1970 | Faulkner | 242/118.8 |
| 3,565,363 | 2/1971 | Mizuguchi et al. | 242/608.4 |
| 3,940,085 | 2/1976 | Campbell . | |
| 4,471,919 | 9/1984 | Leunig | 242/610.6 |
| 4,620,676 | 11/1986 | Missalla | 242/610.1 |
| 5,242,129 | 9/1993 | Bailey et al. . | |
| 5,246,184 | 9/1993 | Trewhella, Jr. . | |
| 5,379,965 | 1/1995 | Isler et al. | 242/586.6 |
| 5,474,254 | 12/1995 | Faulkner | 242/614 |
| 5,575,437 | 11/1996 | Campbell | 242/608.6 |
| 5,605,305 | 2/1997 | Picton | 242/608 |
| 5,660,354 | 8/1997 | Ripplinger | 242/608 |
| 5,806,788 | 9/1998 | Witwer et al. | 242/609.1 |

*Primary Examiner*—Donald P. Walsh
*Assistant Examiner*—William A. Rivera
*Attorney, Agent, or Firm*—Luedeka, Neely & Graham, P.C.

[57] ABSTRACT

A winding or storage reel for large, continuous lengths of flexible materials such as cable, rope or paper is collapsible into substantially flat components for recycling transport. The reel core is preferably twin sheet, vacuum formed of thermoplastic sheet material and comprises a plurality of laterally hinged stave elements in substantially circular alignment between a pair of end flanges. Threaded assembly rods compress the core stave elements between the end flanges. The adjacent lateral edges of the several stave elements are parallel to the core axis and are flexibly joined to hinge about an axis parallel to the lateral edge. One pair of laterally adjacent edges in the core circle are non-pivotally joined by respectively meshing fingers. Two integral plastic sheets respective to inside and outside shell walls are thermoformed to integrate all or several stave elements and hinges into a continuously single component that can be manually formed into the closed perimeter of the reel core cylinder for support of an over-wrapped material. For return transport, the closed perimeter of the core component is opened along the joint edge and developed to a substantially flat configuration.

24 Claims, 9 Drawing Sheets

TWIN SHEET REEL CORE

BACKGROUND OF THE INVENTION

The present invention relates generally to reels for storing, transporting and dispensing great lengths of flexible materials such as cable, rope, paper, foil and film. More particularly, the present invention relates to a reel core that may be selectively separated along a joint and substantially developed onto a planar surface for improved storage and transport density.

Flexible materials such as paper foil, film, cable and rope are produced in indefinitely long lengths by substantially continuous processes. Consequently, reels comprising cylindrical cores or drums secured coaxially between opposite end flanges are the industrial standard for devices to organize, store, transport and dispense such materials. Such reels are generally constructed with axially spaced wood side plates or flanges. Such flanges may be of any structural material but plywood or crossed laminations of wood shiplap are most frequently used. The reel core is axially compressed, by threaded tie rods, for example, between parallel, oppositely facing flange surfaces.

For large, bulk material storage reels, the core is usually made of wound paper or of wood staves. In either case, the core material is humidity responsive and produces dimensional damages as a consequence of humidity changes. Wound paper cores, although providing a smooth outer surface and a strong dense wall annulus, are particularly vulnerable to humidity change. Water absorbed from a humid atmosphere can produce swelling and delamination. Even relatively small quantities of absorbed water can sufficiently weaken a wound paper reel core to cause an internal collapse of the core wall under constrictive compression stress. When the wound material supported by the core is stress sensitive such as fiber optic cable, core compression failures are unacceptably expensive.

Some reel embodiments having wood stave cores may be disassembled after the stored material is removed to consolidate the flange and stave components for more dense and efficient storage or return transport. However, the labor time required for reassembly frequently defeats the savings purpose.

It is therefore, an object of the present invention to provide a moisture impervious reel core.

Another object of the invention is provision of a reel core that may be quickly developed onto a planar surface for compact storage and transport.

Also an object of the invention is an efficient reel recycling method.

A further object of the invention is a sturdy, moisture insensitive reel having minimal assembly components that may be quickly assembled and disassembled.

An additional object of the invention is provision of a material storage reel having essentially flat, dense components.

SUMMARY OF THE INVENTION

These and other objects of the invention as will become apparent from the following detailed description are accomplished by a reel assembly having a substantially cylindrical core compressed between a pair of end flanges by several tension rods. In a preferred embodiment of the invention, opposing faces of the end flanges are provided with substantially circular channels about the reel core axis to receive and confine respective end edges of staves that, when collectively assembled, are the reel core. Several threaded tie rods passing between the end flanges and a void space within the reel core perimeter compress the end flange faces against juxtaposed end edges respective to the core staves.

Generally, the reel core is a substantially cylindrical assembly of staves having parallel lateral edges and end edges. Adjacent lateral edges of adjacent staves are pivotally joined by hinge sections. The lateral edge joint of at least one pair of staves, however, is conventionally separable whereby the closed perimeter of a core cylinder may be opened and the cylinder perimeter developed onto a planar surface as a plurality of pivotally connected segments of a circle.

A further characteristic of the invention preferred embodiment is a reel core that is fabricated as the unitized composition of two, thermoformed sheets of polymer material. The two thermoplastic sheets are mostly separated over each of the stave areas as shell walls that enclose an interior void space. The void space respective to the staves is interrupted by several spaced ribs formed by fusing strips of one sheet to the other. The ribs serve as panel stiffeners for increased buckling strength.

Over a relatively short circumferential distance between adjacent staves, the two thermoplastic sheets are fused together in an asymmetrically corrugated pattern wherein parallel corrugation flutes are substantially parallel with the stave lateral edges. This corrugated linkage between the staves provides a concentrated area of low bending strength and serves the stave hinge function.

BRIEF DESCRIPTION OF THE DRAWINGS

The invention is hereafter described in detail by reference to the drawings wherein.

DESCRIPTION OF THE PREFERRED EMBODIMENTS

Figure 1:
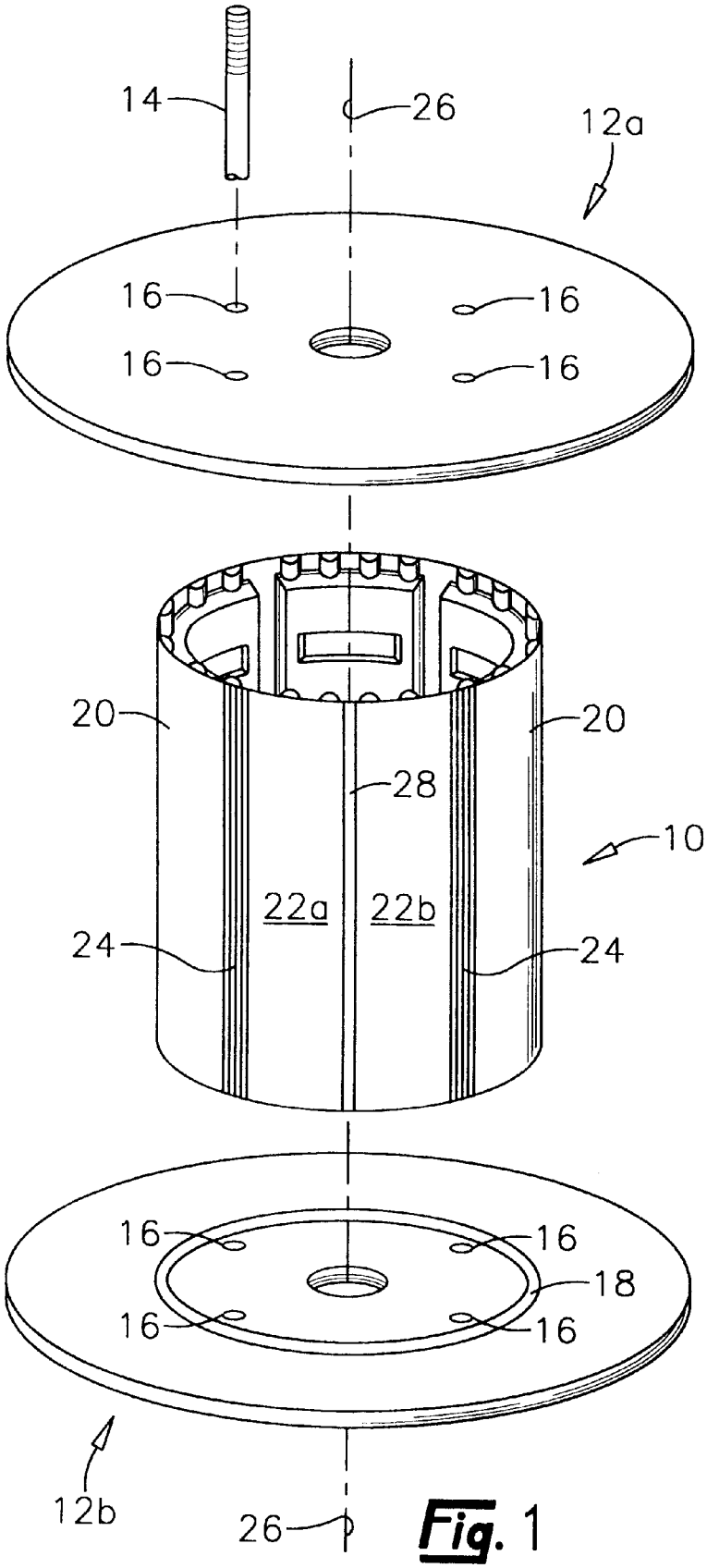
FIG. 1 is an exploded assembly perspective of the invention.

Referring to the drawings wherein like reference characters designate like or similar elements throughout the several figures of the drawings, FIG. 1 illustrates an exploded assembly of a preferred embodiment for a material storage reel according to the invention. The basic composition of the reel assembly comprises a substantially cylindrical core 10 that is axially compressed between two end flanges 12*a* and 12*b*. Threaded tie rods 14 are aligned through apertures 16 in the end flanges 12 and internally of the core 10 annulus to compress the assembly. A circular channel 18 in each flange face confines the core 10 to a coaxial location against the flange faces.

Figure 2:
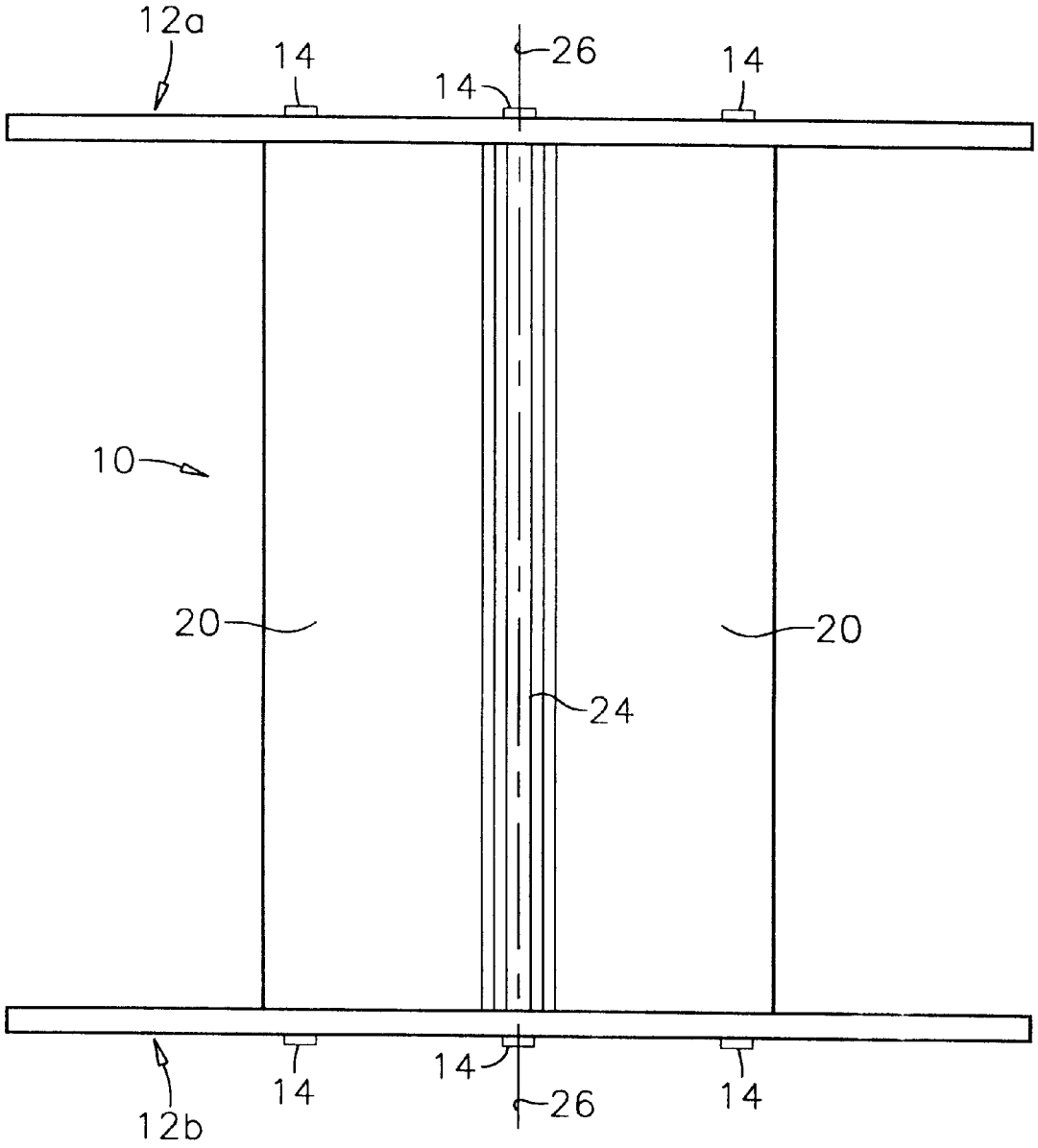
FIG. 2 is an orthographic elevation view of the invention.

FIG. 2 illustrates the same reel as shown by FIG. 1 but with the several components in their correctly unified position. As assembled, a reel according to the invention may be used for winding and storing large, continuous lengths of flexible materials such as cable, rope, paper and metal or plastic sheet. When the materials are used or delivered, the reel may be disassembled and all of the reel components repositioned for efficient storage or transport.

Figure 8:
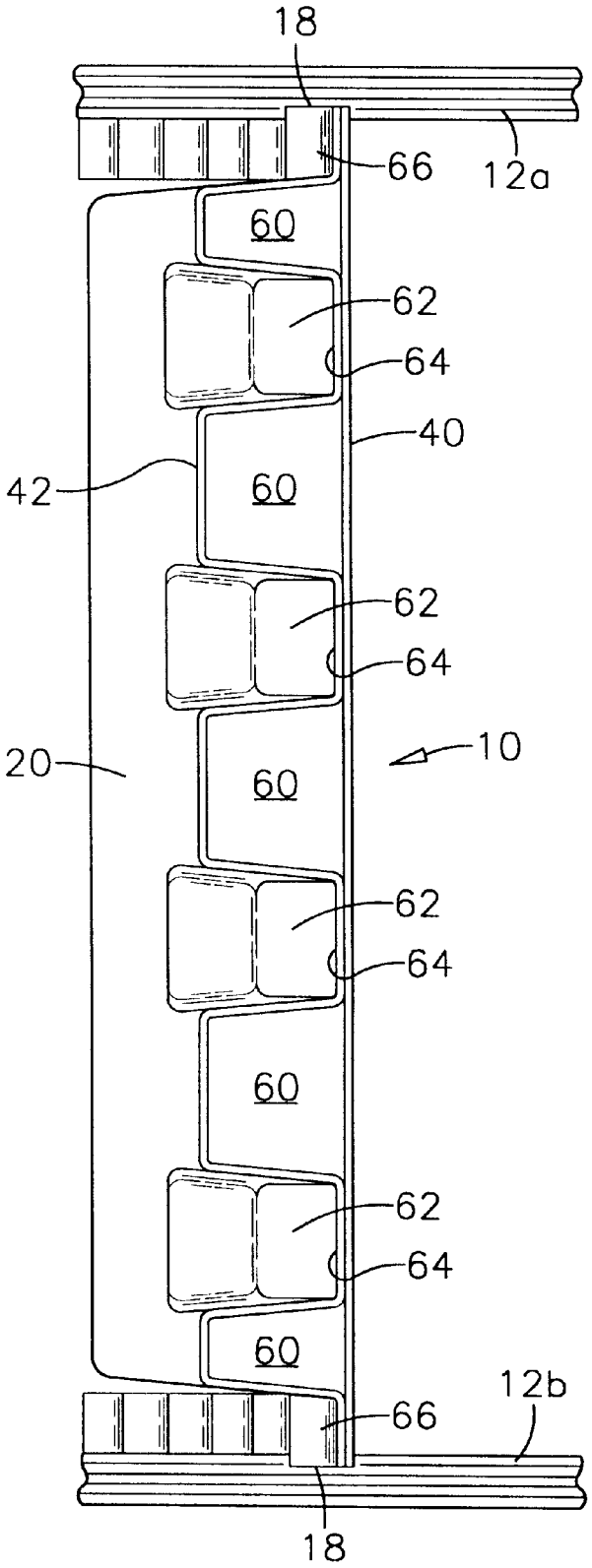
FIG. 8 is a sectioned detail of the invention joint connection between the core end edges and the reel flanges.

Each reel flange 12 is preferably a plywood disc as shown by the partial section of FIG. 8 having a dadoed channel around the reel for coaxially confining the core ends. Alternatively, however, the core ends may also be confined by other obvious devices such as internal or external blocking not shown. Additionally, the reel flanges 12 may be constructed of materials other than plywood such as molded plastic or metal.

Figure 6:
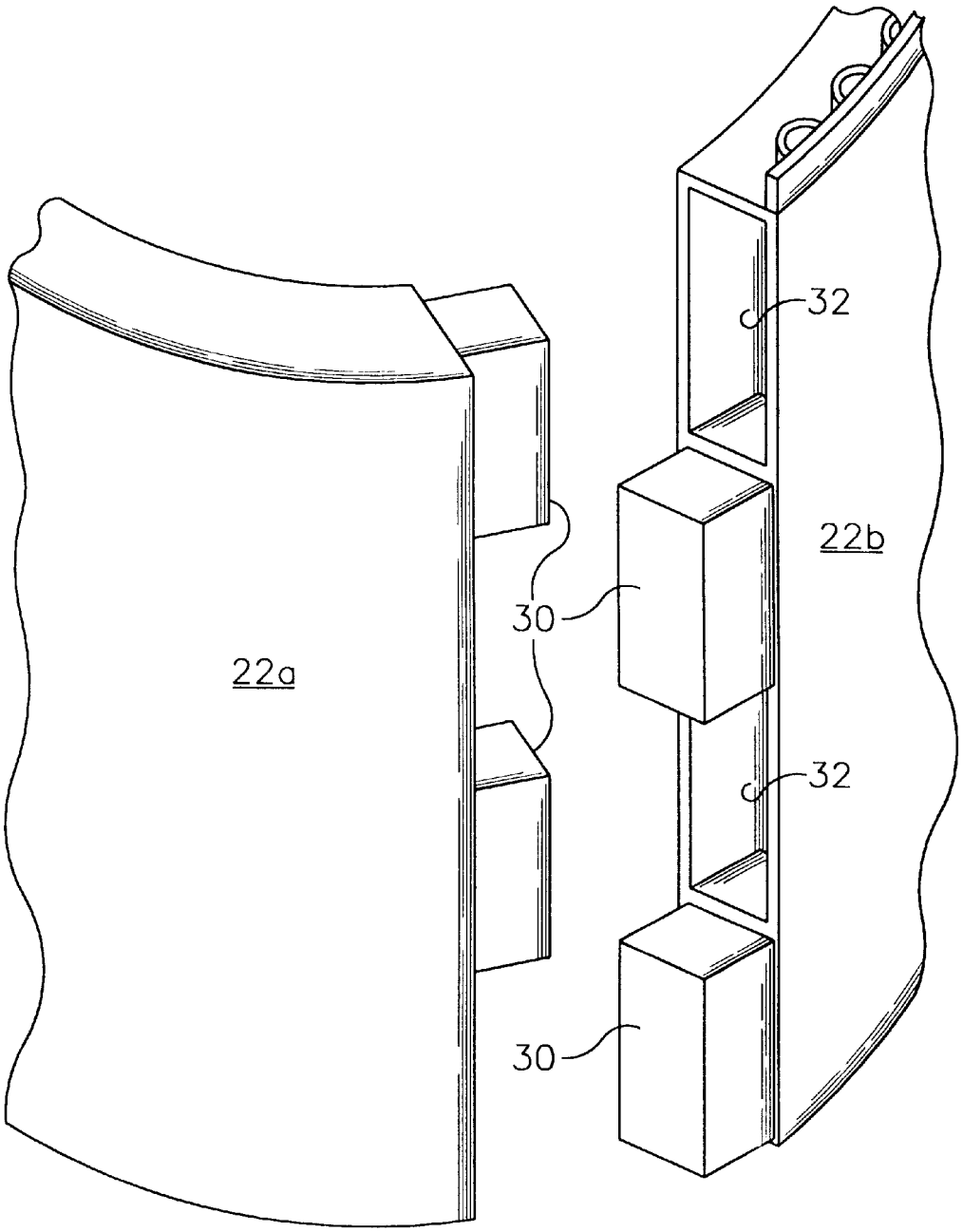
FIG. 6 is a partial isometric view of a preferred embodiment for securing the invention core blank in a closed geometry.

Referring to FIGS. 3–6, the reel core 10 comprises several stave sections 20 and a pair of half-staves 22*a* and 22*b*. The staves are laterally delineated by hinge sections 24 which pivotally link adjacent staves about an undefined axis that is substantially parallel to the reel axis 26. Half staves 22*a* and 22*b*, however, are joined along a butt edge 28 by meshing fingers 30 and socket enclosures 32 as best illustrated by FIG. 6.

Figure 9:
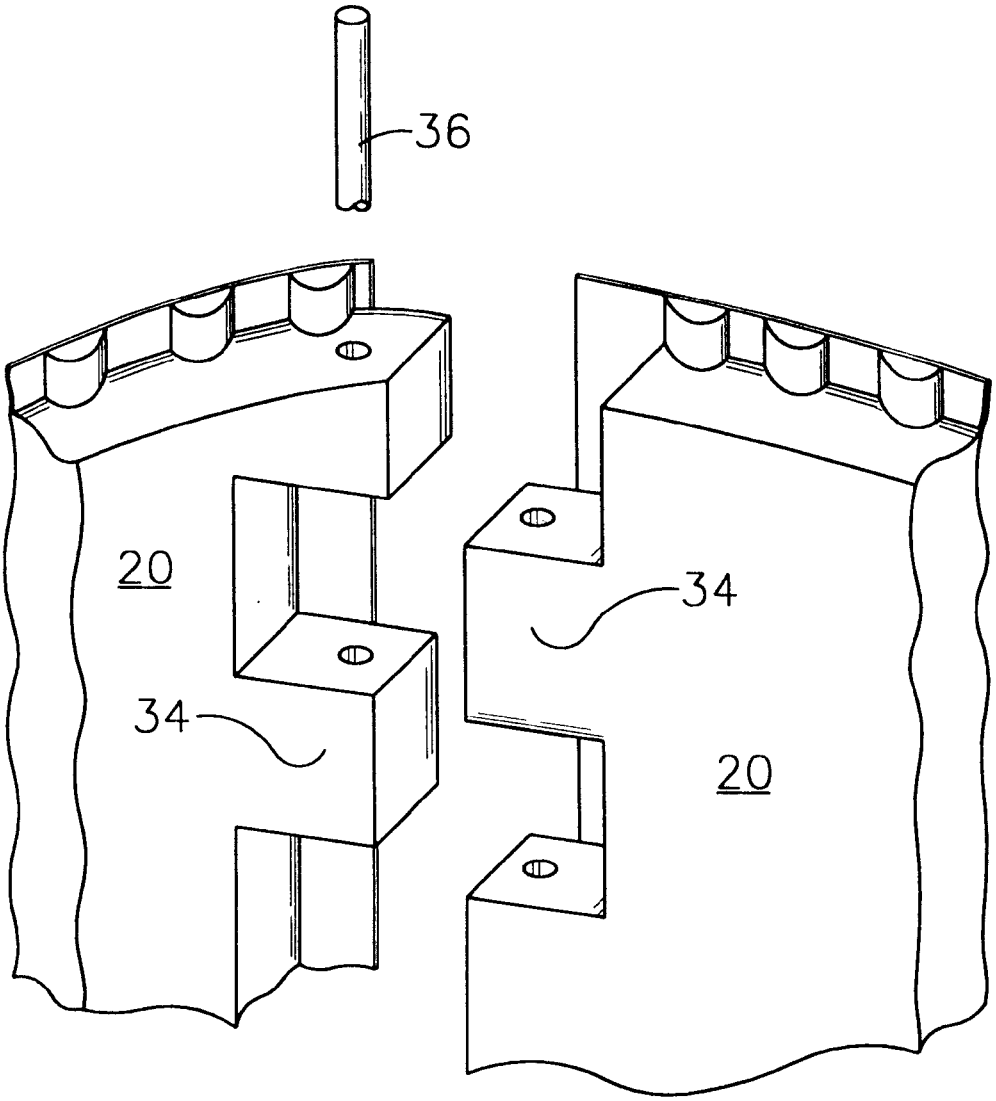
FIG. 9 is a partial isometric view of an alternative embodiment of the invention.

In the alternative embodiment of FIG. 9, staves 20 or half-staves 22 may be joined by openly meshing fingers 34. The openly meshing joint is preferably secured by a hinge pin 36. A preferred embodiment of the invention would connect all of the staves 20 and 22 in a core 10 cylinder by integral hinge sections 24 and secure a perimeter closure by a meshing finger joint such as butt edge 28 or that of FIG. 9. If desired, however, each of the staves 20 may be formed as an independent component having finger joints along both edges. In this manner the independent staves may be coupled together laterally to construct cores 10 of different diameters and perimeters. After each use, the joints are separated by extracting fingers 30 from sockets 32 or removing hinge pins 36 from the open fingers 34 and the individual staves 20.

Figure 7:
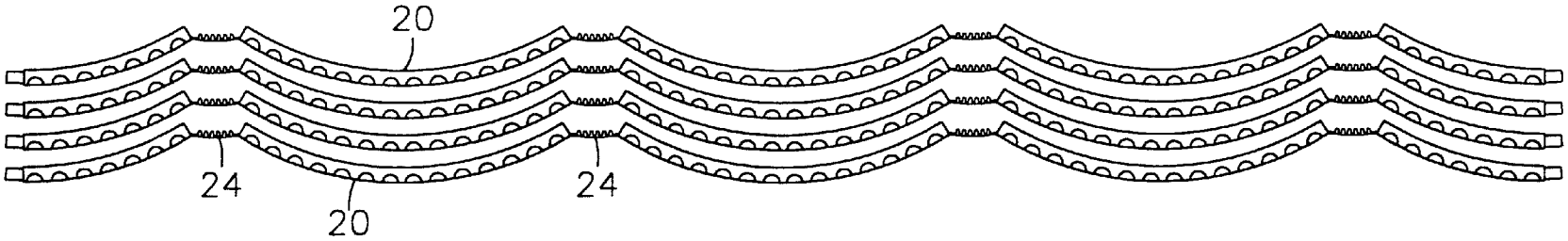
FIG. 7 is an end elevational view of a layered stack of reel core blanks according to the invention that are developed into a plane for efficient storage or transport.

As illustrated by FIG. 7, a core 10 formed by a plurality of integrally hinged staves 20 may be opened along the butt joint 28 and developed onto a flat surface for efficient storage. The advantage of this FIG. 7 embodiment is that the entire core perimeter is integrated into a single, integrally formed component having a flexible geometry. When the butt joint 28 is separated, the entire core perimeter may be developed as an integral unit. Moreover because of shallow arcs respective to each stave 20 in an integral unit, a multiplicity of developed core units may be vertically nested as shown.

Each stave 20, whether as an individual component or as an integrated portion of a combined core assembly, is preferably the product of a twin sheet forming process. Pursuant to such a process, a first or outer sheet of thermoplastic polymer 40 is heated and positioned hot against a vacuum forming bottom mold and deformed over the bottom mold surfaces by atmospheric pressure when void space between the bottom mold surfaces and the hot sheet 40 is abruptly evacuated.

With the outer sheet 40 formed and the molding apparatus in intimate contact with the bottom mold surfaces, the second or inner sheet 42 of preheated polymer is positioned against a top molded surface to be vacuum formed in the same manner as the outer sheet. With the two sheets drawn tightly against respective top and bottom mold surfaces, the two mold units are brought together. Predetermined elements of the inner sheet 42 engage the outer sheet 40 and vice versa. Complete closure of the two molding units fuses the outer and inner sheets together at the designated contact positions.

Figure 3:
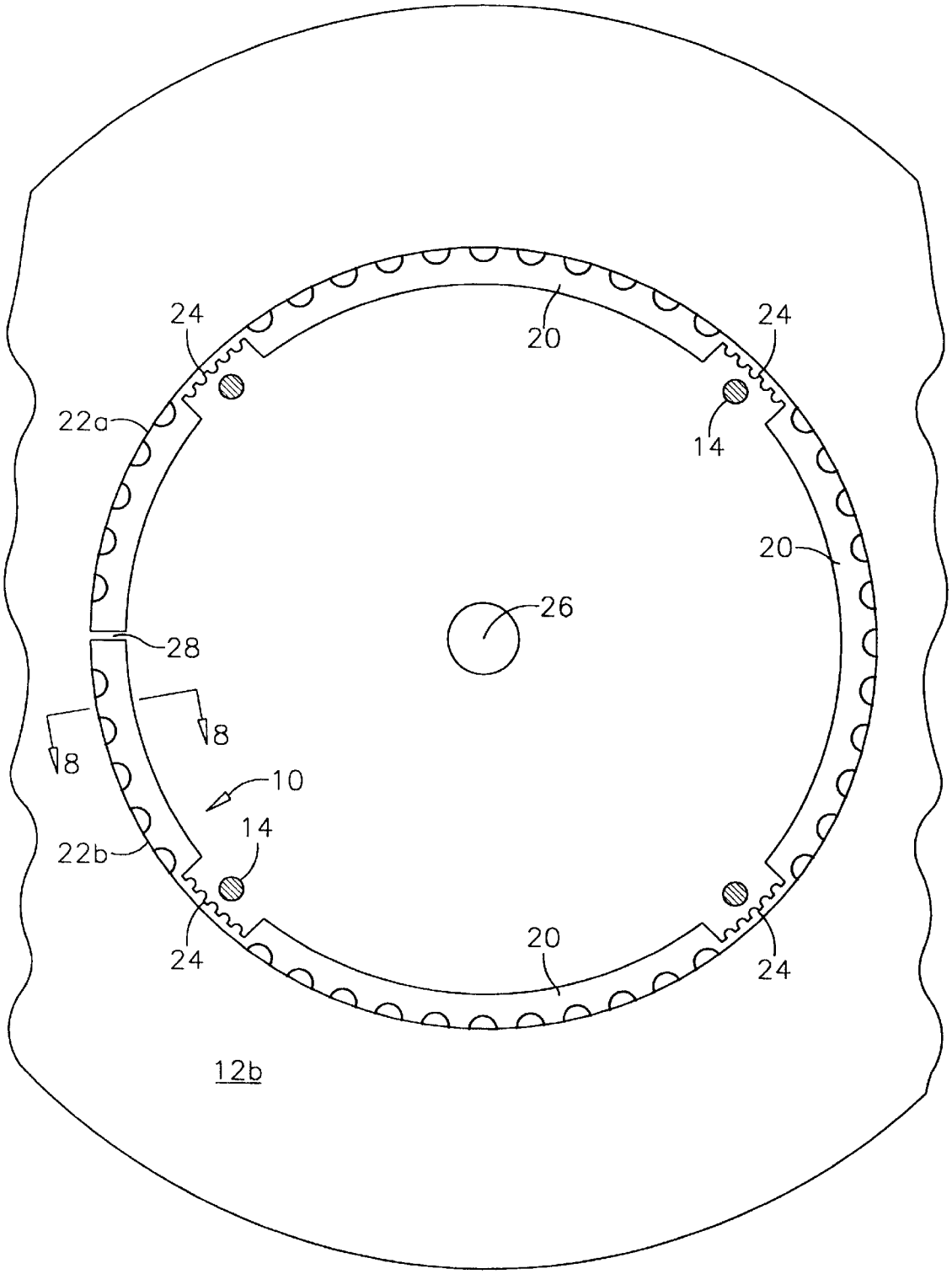
FIG. 3 is a sectional view of the invention along the cutting plane 3—3 of FIG. 2.
Figure 4:
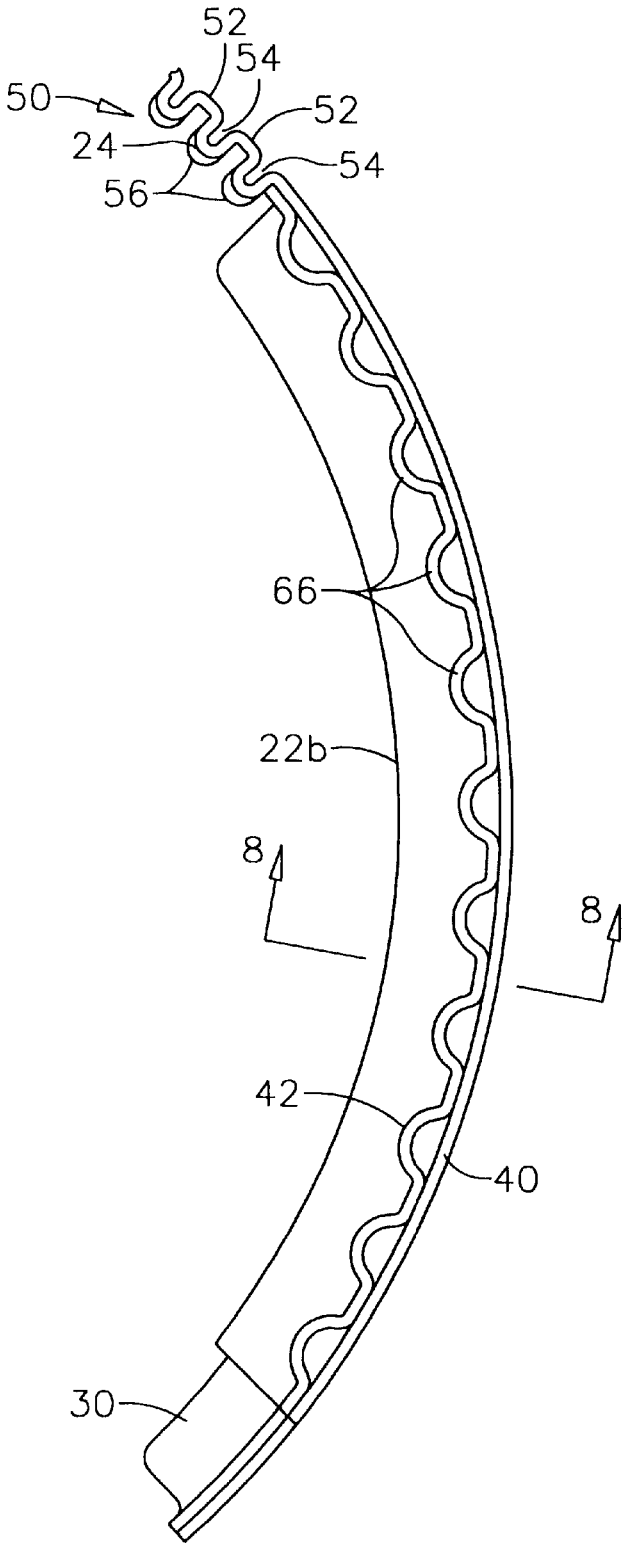
FIG. 4 is a detailed end view of a core stave according to the invention.
Figure 5:
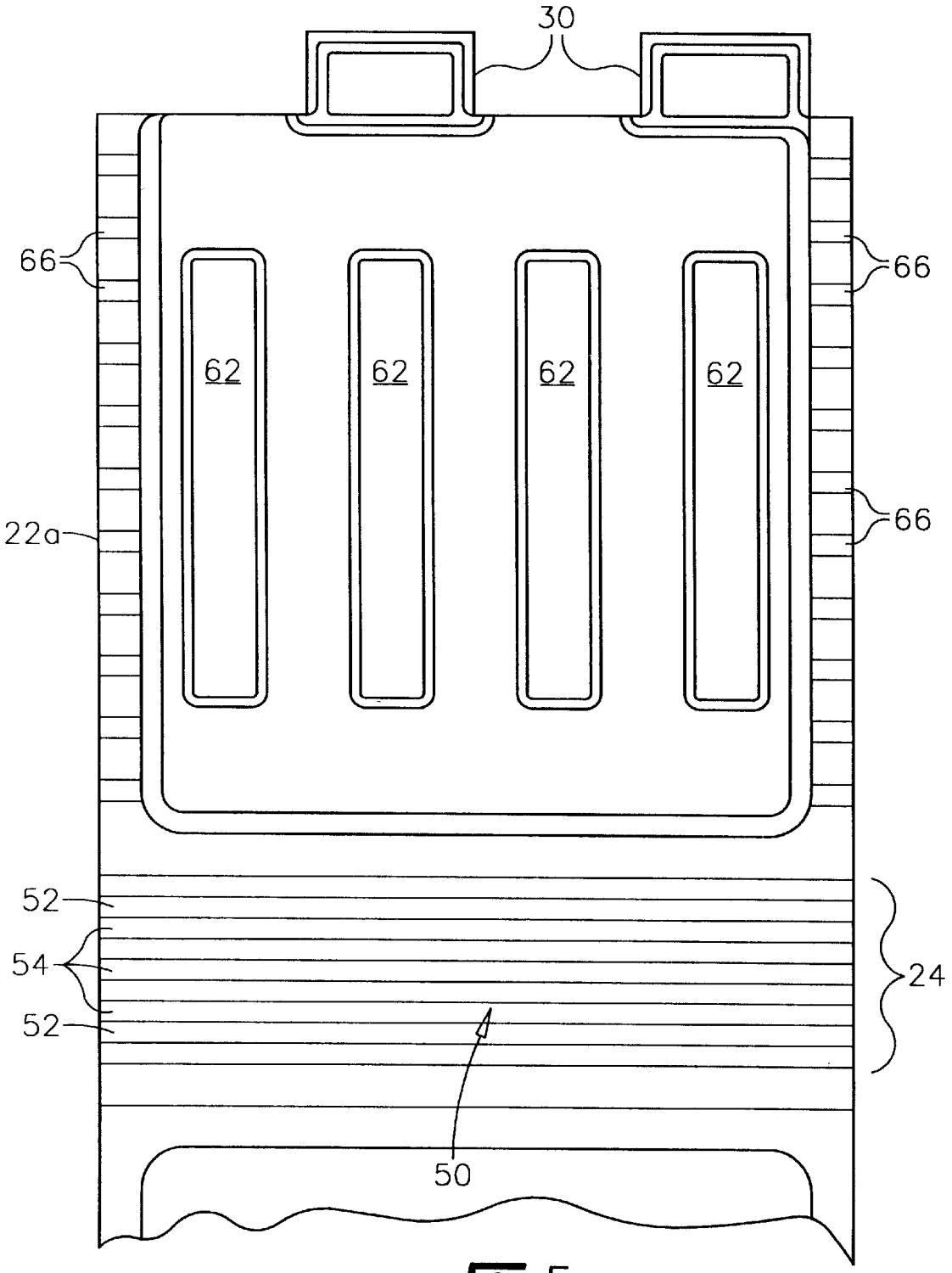
FIG. 5 is a plan view of the interior face of a core stave according to the invention.

FIGS. 3, 4 and 8 are particularly useful to an understanding of how the twin sheet vacuum mold process described above particularly compliments the invention. Each stave section 20 represents an arc segment of the circular cross-section for the core 10. Some products such as paper, metal foils and fiber optic cable require a substantially smooth outer core surface. For such applications, the outer sheet 40 is molded into three stave segments 20 and two half stave segments 22*a* and 22*b*. The outer sheet 40, which may be a continuously integral sheet of ¼ inch polyvinylchloride, for example, is formed into five laterally adjacent shallow tray sections of the core 20 cylinder surface. Except for the hinge sections 24 between the tray sections, the outer surface of sheet 40 is substantially smooth and uninterrupted.

The inner sheet 42 is fused with the outer sheet 40 along each of the hinge areas 24. The inner and outer sheet fusion creates a unitized web that is generally corrugated. The corrugation flutes 50 extend parallel with the core axis 26. See FIGS. 4 and 5. Preferably, the corrugation is asymmetric whereby the outer ridges 52 of the flutes 50 are in circular continuity with the outer stave surfaces. Between the ridges 52 are outer channels 54 having a transverse width that is sized to function as a line of bending weakness. In some cases, the transverse width of the channels 54 may be limited by the properties of the material wrapped around the reel. These same limitations bear upon the number of flutes 50 required across a hinge area and the resulting angular width of the hinge area. Due to these several competing parameters, the inside flute ridges 56 are not necessarily symmetric with the outside ridge 52 due to total material volume management.

As previously explained, the hinge areas 24 laterally delineate the staves 20 and 22. From the hinge areas, the inner sheet 42 is molded to a position that is substantially parallel but spacially separated from the outer sheet 40 thereby forming a void space between the respective sheets. The sheets 40 and 42 thereby form a structural shell that generally encloses the void space 60. The continuity of the void space 60, however, is interrupted by several internal ribs 62 that are formed by molding a pocket depression in the inner sheet 42 having a bottom surface 64 that is fused to the outer sheet 40. These internal ribs 62 contribute to the buckling strength and panel stiffness of the staves.

The inner sheet 42 is also corrugated along the axial ends of the core staves with spaced flutes 66. Referring to FIG. 8, the spaced flutes 66 provide depth and concentricity to the core 10 end fit with the flange channels 18. Additionally, these spacer flutes 66 increase the core edge stiffness and strength to preempt compressive edge failure.

The essential characteristics of the invention allow a large degree of modification and design latitude. For example, the planar developed profile, e.g. FIG. 7, for a large diameter core 10 may obviously be reduced by increasing the number of stave sections 20 in the core circumference thereby reducing the degree of angular arc assigned to each stave. Moreover, the planar development length of an integral core section may be reduced by employing two more integral sections around the core perimeter that are joined by meshing fingers 30 or 34. This latter concept may be carried to the extreme whereby each stave section is independent of others and adjacent lateral edges of adjacent stave sections are joined by a mechanical connection have a disassembly capacity such as illustrated by FIG. 9.

Depending on the degree of tolerable clearance between the thickness of spacer flutes 66 and the width of the center confinement channel 18, the number of stave sections 20 may, within a predetermined range of limits, be selected for a range of core diameters. Usually, however, the circular arc of each stave section 20, for example, is substantially fixed and formed to close with a single, predetermined diameter and circumference.

Having fully disclosed the preferred and some alternative embodiments of the invention, is should be understood that the invention is not limited to the precise details herein illustrated and specifically described since the same may predictably be arrived out in the other ways that are encompassed by the reasonable scope of the following claims or by reasonable equivalents thereof.

As our invention, therefore,

We claim:

1. A material winding reel comprising a substantially cylindrical core having opposite ends thereof compressed between respective flange means, said cylindrical core comprising a plurality of stave elements distributed around a cylinder axis and along a substantially circular perimeter, said stave elements having substantial void volumes enclosed by inside and outside shell walls, adjacent lateral edges respective to adjacent stave elements being pivotally joined for articulation about an axis that is substantially parallel to an axis of said cylindrical core.

2. A material winding reel as described by claim 1 wherein the respective lateral edges of at least one pair of adjacent lateral edges in said plurality of stave elements are non-pivotally joined by linkage means.

3. A material winding reel as described by claim 2 wherein said linkage means comprises selectively meshed finger means to secure an alignment of said one pair of adjacent lateral edges.

4. A material winding reel as described by claim 1 wherein the material substance of said staves comprises a thermally formed polymer material.

5. A material winding reel as described by claim 4 wherein said inside and outside shell walls are fused together substantially without a void volume therebetween to form respective hinge axes between adjacent stave elements.

6. A material winding reel as described by claim 5 wherein said inside and outside shell walls are continuously common to substantially all staves in said plurality.

7. A collapsible cylinder comprising a plurality of surface elements having lateral edges and end edges, the lateral edges of adjacent surface elements having substantially parallel alignment with a cylinder axis and pivotally joined for articulation about respective hinge axes, said surface elements having substantial void volumes enclosed by inside and outside shell walls, a pair of end forming means having alignment means on respectively opposed faces for confining said surface elements about a substantially circular perimeter, and compression means for axially confining said surface elements between the opposed faces of said pair of forming means.

8. A collapsible cylinder as described by claim 7 wherein the lateral edges of at least one pair of adjacent lateral edges in a substantially circular perimeter of said surface elements are non-pivotally joined by linkage means.

9. A collapsible cylinder as described by claim 8 wherein said linkage means comprises selectively meshed finger means to secure an alignment of said one pair of adjacent lateral edges.

10. A collapsible cylinder as described by claim 7 wherein the material substance of said shell walls substantially comprises a thermally formed polymer material.

11. A collapsible cylinder as described by claim 10 wherein said inside and outside shell walls are fused together substantially without a void volume therebetween to form respective hinge axes between adjacent lateral edges.

12. A collapsible cylinder as described by claim 7 wherein said inside and outside shell walls are continuously common to all surface elements in said plurality.

13. A collapsible cylinder as described by claim 9 wherein said compression means comprises a plurality of threaded rod members disposed between said end forming means substantially parallel with said lateral edges of said surface elements, said threaded rod disposition being within said circular perimeter.

14. A collapsible cylinder as described by claim 7 wherein said alignment means comprises a substantially circular channel in a face of a respective end forming means.

15. A method of storing lengths of flexible material comprising the steps of:

A. forming a core blank by pivotally linking a plurality of core stave element, said slave elements having an inner wall, an outer wall and substantial void space between said walls;

B. forming a reel core by wrapping said core blank about a reel core axis into a substantially closed perimeter having substantially cylindrical surface elements and axially opposite end elements;

C. assembling a material storage reel by axially compressing said reel core between end flanges secured against respectively opposite core end elements;

D. wrapping a flexible material about said storage reel;

E. unwrapping said flexible material from said storage reel;

F. disassembling said storage reel by removing said end flanges from said reel core; and G. unwrapping said reel core from about said reel core axis to an expanded core blank.

16. A method as described by claim 15 wherein said core blank walls are formed by a pair of thermoplastic sheets that are substantially separated over stave elements of said blank and fused together along hinge sections that pivotally link said stave elements.

17. A method as described by claim 16 wherein said hinge sections are corrugated whereby corrugation flutes are in substantially parallel alignment with said core axis.

18. A method as described by claim 16 wherein said thermoplastic sheets enclose a void space therebetween over a substantial portion of each stave element.

19. A material winding reel comprising a substantially cylindrical core subtended at opposite axial ends thereof by respective flange means, said cylindrical core comprising a plurality of stave elements compressed between said flanges in laterally adjacent alignment about a closed perimeter, said staves having an inner wall and an outer wall, said walls being substantially parallel and separated to enclose a void space therebetween.

20. A material winding reel as described by claim 19 wherein said stave walls are formed by thermoplastic sheet material.

21. A material winding reel as described by claim 19 wherein said stave walls have lateral edges extending substantially between said flanges with adjacent lateral edges respective to adjacent staves being secured together.

22. A material winding reel as described by claim 21 wherein said adjacent lateral edges are secured together by hinge means.

23. A material winding reel as described by claim 22 wherein said inner and outer walls are formed of respective thermoplastic material sheets, said sheet being fused together to form said hinge means.

24. A material winding reel as described by claim 21 wherein said adjacent lateral edges are secured together by meshing connector means.

* * * * *